US007823257B2

(12) United States Patent
Bossmann

(10) Patent No.: US 7,823,257 B2
(45) Date of Patent: Nov. 2, 2010

(54) APPARATUS FOR THE FIBRE-SORTING OR FIBRE-SELECTION OF A FIBRE BUNDLE COMPRISING TEXTILE FIBRES, ESPECIALLY FOR COMBING

(75) Inventor: Johannes Bossmann, Mönchengladbach (DE)

(73) Assignee: Fa. Trützschler GmbH & Co. KG, Mönchengladbach (DE)

( * ) Notice: Subject to any disclaimer, the term of this patent is extended or adjusted under 35 U.S.C. 154(b) by 211 days.

(21) Appl. No.: 12/149,506

(22) Filed: May 2, 2008

(65) Prior Publication Data

US 2009/0000079 A1 Jan. 1, 2009

(30) Foreign Application Priority Data

| | | |
|---|---|---|
| Jun. 29, 2007 | (DE) | 10 2007 030 392 |
| Jun. 29, 2007 | (DE) | 10 2007 030 471 |
| Jun. 29, 2007 | (DE) | 20 2007 010 686 U |
| Jan. 11, 2008 | (DE) | 10 2008 004 097 |

(51) Int. Cl.
*D01G 19/00* (2006.01)

(52) U.S. Cl. ..... 19/115 R

(58) Field of Classification Search ..... 19/115 R–235
See application file for complete search history.

(56) References Cited

U.S. PATENT DOCUMENTS

| | | | |
|---|---|---|---|
| 4,270,245 | A | 6/1981 | Stewart et al. |
| 6,295,699 | B1 | 10/2001 | Temburg |
| 2005/0076476 | A1 | 4/2005 | Temburg |
| 2008/0092339 | A1 | 4/2008 | Bossman |
| 2009/0000064 | A1 | 1/2009 | Saeger et al. |
| 2009/0000065 | A1 | 1/2009 | Saeger et al. |

(Continued)

FOREIGN PATENT DOCUMENTS

DE 382169 A * 6/1920

(Continued)

OTHER PUBLICATIONS

German Patent Office Search Report, dated Aug. 8, 2007, issued in related German Application No. 10 2006 050 384.8, and English language translation of Section C.

(Continued)

*Primary Examiner*—Shaun R Hurley
(74) *Attorney, Agent, or Firm*—Venable LLP; Robert Kinberg; Steven J. Schwarz

(57) ABSTRACT

In an apparatus for the fiber-sorting or fiber-selection of a fiber bundle, especially for combing, which is supplied by means of supply device to a fiber-sorting device, especially a combing device, in which a mechanical device is present which generates a combing action to loosen and remove non-clamped constituents, and a clamping element is present for transfer of the supplied fiber material. To enable productivity to be increased in a simple manner and an improved combed sliver to be obtained, downstream of the supply device there are arranged two rotatably mounted rollers, which are provided with clamping devices for the fiber material having clamping elements that are distributed spaced apart in the region of the roller periphery and co-operate with counter-elements, the counter-elements in the case of the first roller being arranged opposite the roller periphery and in the case of the second roller on or in the roller.

25 Claims, 4 Drawing Sheets

U.S. PATENT DOCUMENTS

| | | | | |
|---|---|---|---|---|
| 2009/0000066 | A1 | 1/2009 | Saeger et al. | |
| 2009/0000067 | A1 | 1/2009 | Leder et al. | |
| 2009/0000068 | A1 | 1/2009 | Saeger et al. | |
| 2009/0000069 | A1 | 1/2009 | Saeger et al. | |
| 2009/0000070 | A1 | 1/2009 | Saeger et al. | |
| 2009/0000071 | A1 | 1/2009 | Saeger et al. | |
| 2009/0000072 | A1 | 1/2009 | Saeger et al. | |
| 2009/0000073 | A1 | 1/2009 | Saeger et al. | |
| 2009/0000074 | A1 * | 1/2009 | Bossmann | 19/115 R |
| 2009/0000075 | A1 | 1/2009 | Saeger et al. | |
| 2009/0000076 | A1 | 1/2009 | Bossmann | |
| 2009/0000077 | A1 | 1/2009 | Saeger et al. | |
| 2009/0000078 | A1 | 1/2009 | Saeger et al. | |

FOREIGN PATENT DOCUMENTS

| | | | | |
|---|---|---|---|---|
| DE | 399885 | A | * | 5/1921 |
| DE | 367482 | | | 1/1923 |
| DE | 489 420 | | | 1/1930 |
| DE | 30 48 501 | A1 | | 7/1982 |
| DE | 103 20 452 | A1 | | 11/2004 |
| EP | 1 586 682 | A1 | | 2/2005 |
| WO | WO-2006/012758 | A1 | | 2/2006 |

OTHER PUBLICATIONS

German Patent Office Search Report, dated Jul. 10, 2007, issued in related German Application No. 10 2006 050 453.4, and partial English-language translation.

* cited by examiner

APPARATUS FOR THE FIBRE-SORTING OR FIBRE-SELECTION OF A FIBRE BUNDLE COMPRISING TEXTILE FIBRES, ESPECIALLY FOR COMBING

CROSS REFERENCE TO RELATED APPLICATIONS

The present application claims priority from German Patent Application No. 10 2007 030 392.2 dated Jun. 29, 2007, German Utility Model Application No. 20 2007 010 686.6 dated Jun. 29, 2007, and German Patent Application No. 10 2008 004 097.5 dated Jan. 11, 2008, the entire disclosure of each of which is incorporated herein by reference.

BACKGROUND OF THE INVENTION

The invention relates to an apparatus for the fibre-sorting or fibre-selection of a fibre bundle comprising textile fibres, especially for combing. In known apparatus, a fibre bundle is supplied by means of a supply device to a fibre-sorting device, especially to a combing device, in which clamping devices are provided, which clamp the fibre bundle at a distance from its free end and a mechanical device is present which generates a combing action from the clamping site to the free end of the fibre bundle in order to loosen and remove non-clamped constituents, such as, for example, short fibres, neps, dust and the like from the free end. A clamping element is present to take up the supplied fibre material.

In practice, combing machines are used to free cotton fibres or woollen fibres of natural impurities contained therein and to parallelise the fibres of the fibre sliver. For that purpose, a previously prepared fibre bundle is clamped between the jaws of the nipper arrangement so that a certain sub-length of the fibres, known as the "fibre tuft", projects at the front of the jaws. By means of the combing segments of the rotating combing roller, which segments are filled with needle clothing or toothed clothing, this fibre tuft is combed and thus cleaned. The take-off device usually consists of two counter-rotating rollers, which grip the combed fibre tuft and carry it onwards. The known cotton-combing process is a discontinuous process. During a nipping operation, all assemblies and their drive means and gears are accelerated, decelerated and in some cases reversed again. High nip rates result in high acceleration. Particularly as a result of the kinematics of the nippers, the gear for the nipper movement and the gear for the pilgrim-step movement of the detaching rollers, high acceleration forces come into effect. The forces and stresses that arise increase as the nip rates increase. The known flat combing machine has reached a performance limit with its nip rates, which prevents productivity from being increased. Furthermore, the discontinuous mode of operation causes vibration in the entire machine, which generates dynamic alternating stresses.

EP 1 586 682 A discloses a combing machine in which, for example, eight combing heads operate simultaneously one next to the other. The drive of those combing heads is effected by means of a lateral drive means arranged next to the combing heads having a gear unit which is in driving connection by way of longitudinal shafts with the individual elements of the combing heads. The fibre slivers formed at the individual combing heads are transferred, one next to the other on a conveyor table, to a subsequent drafting system in which they are drafted and then combined to form a common combing machine sliver. The fibre sliver produced in the drafting system is then deposited in a can by means of a funnel wheel (coiler plate). The plurality of combing heads of the combing machine each have a feed device, a pivotally mounted, fixed-position nipper assembly, a rotatably mounted circular comb having a comb segment for combing out the fibre tuft supplied by the nipper assembly, a top comb and a fixed-position detaching device for detaching the combed-out fibre tuft from the nipper assembly. The lap ribbon supplied to the nipper assembly is here fed via a feed cylinder to a detaching roller pair. The fibre tuft protruding from the opened nipper passes onto the rearward end of a combed sliver web or fibre web, whereby it enters the clamping nip of the detaching rollers owing to the forward movement of the detaching rollers. The fibres that are not retained by the retaining force of the lap ribbon, or by the nipper, are detached from the composite of the lap ribbon. During this detaching operation, the fibre tuft is additionally pulled by the needles of a top comb. The top comb combs out the rear part of the detached fibre tuft and also holds back neps, impurities and the like. Owing to the differences in speed between the lap ribbon and the detaching speed of the detaching rollers, the detached fibre tuft is drawn out to a specific length. Following the detaching roller pair is a guide roller pair. During this detaching operation, the leading end of the detached or pulled off fibre bundle is overlapped or doubled with the trailing end of the fibre web. As soon as the detaching operation and the piecing operation have ended, the nipper returns to a rear position in which it is closed and presents the fibre tuft protruding from the nipper to a comb segment of a circular comb for combing out. Before the nipper assembly now returns to its front position again, the detaching rollers and the guide rollers perform a reversing movement, whereby the trailing end of the fibre web is moved backwards by a specific amount. This is required to achieve a necessary overlap for the piecing operation. In this way, a mechanical combing of the fibre material is effected. Disadvantages of that combing machine are especially the large amount of equipment required and the low hourly production rate. There are eight individual combing heads which have in total eight feed devices, eight fixed-position nipper assemblies, eight circular combs with comb segments, eight top combs and eight detaching devices. A particular problem is the discontinuous mode of operation of the combing heads. Additional disadvantages result from large mass accelerations and reversing movements, with the result that high operating speeds are not possible. Finally, the considerable amount of machine vibration results in irregularities in the deposition of the combed sliver. Moreover, the ecartement, that is to say the distance between the nipper lip of the lower nipper plate and the clamping point of the detaching cylinder, is structurally and spatially limited. The rotational speed of the detaching rollers and the guide rollers, which convey the fibre bundles away, is matched to the upstream slow combing process and is limited by this. A further drawback is that each fibre bundle is clamped and conveyed by the detaching roller pair and subsequently by the guide roller pair. The clamping point changes constantly owing to the rotation of the detaching rollers and the guide rollers, i.e. there is a constant relative movement between the rollers effecting clamping and the fibre bundle. All fibre bundles have to pass through the one fixed-position detaching roller pair and the one fixed-position guide roller pair in succession, which represents a further considerable limitation of the production speed.

SUMMARY OF THE INVENTION

It is the aim of the invention to provide an apparatus of the kind described at the beginning which avoids or mitigates the mentioned disadvantages and which in a simple way, in particular, enables the amount produced per hour (productivity) to be substantially increased and an improved combed sliver to be obtained.

The invention provides an apparatus for the fibre-sorting or fibre-selection of a fibre bundle comprising textile fibres having:

a fibre-sorting device;

a supply device for supplying the fibre bundle to the fibre-sorting device; and at least one mechanical device for generating a combing action in order to loosen and remove non-clamped constituents from the fibre bundle;

wherein the fibre-sorting device comprises, arranged downstream of the supply device, at least two rotatably mounted rollers that, in use, rotate rapidly without interruption, each of said at least two rollers having clamping elements distributed spaced apart in the region of their periphery and co-operating with one or more counter-elements, wherein the counter-elements in the case of the first roller are opposite the periphery of the roller and the counter-elements in the case of the second roller are arranged on or in the roller.

By implementing the functions of clamping and moving the fibre bundles to be combed-out on rotating rollers, high operating speeds (nip rates) are achievable—unlike the known apparatus—without large mass accelerations and reversing movements. In particular, the mode of operation is continuous. When a high-speed roller is used, a very substantial increase in hourly production rate (productivity) is achievable which had previously not been considered possible in technical circles. A further advantage is that the rotary rotational movement of the roller with the plurality of clamping devices leads to an unusually rapid supply of a plurality of fibre bundles per unit of time to the first roller and to the second roller. In particular the high rotational speed of the rollers allows production to be substantially increased. The fibre bundles are—unlike the known apparatus—held by a plurality of clamping devices and transported under rotation. The clamping point at the particular clamping devices therefore remains constant until the fibre bundles are transferred to the first and second rollers. A relative movement between clamping device and fibre bundle does not begin until after the fibre bundle has been gripped by the first or second roller respectively and in addition clamping has been terminated. Because a plurality of clamping devices is available for the fibre bundles, in an especially advantageous manner fibre bundles can be supplied to the first or second roller respectively one after the other and in quick succession, without undesirable time delays resulting from just a single supply device. A particular advantage is that the supplied fibre bundles on the first roller (turning rotor) are continuously transported. The speed of the fibre bundle and of the co-operating clamping elements is the same. The clamping elements close and open during the movement in the direction of the transported fibre material. The second roller (combing rotor) is arranged downstream of the first roller (turning rotor).

In certain preferred embodiments, on the first roller (turning roller) a suction air current acts on the fibre bundle (fibre portion), which suction air current is capable of holding the fibre bundle on the first roller. It is preferred that the fibre bundle on the first roller is partially acted upon by suction.

The clamping devices advantageously clamp the fibre bundle (fibre portion) at a distance from its free end. Advantageously, the clamping devices are in two parts. Advantageously, a clamping device (for example, clamping elements and at least one counter-element) is present on the first roller to separate the supplied fibre material stepwise into individual fibre bundles.

To form the fibre bundle (also referred to herein as "fibre tuft"), the fibre sliver pushed forward by the feed roller is clamped at one end by a clamping device and detached by the rotary movement of the turning rotor. The clamped end contains short fibres, the free region comprises the long fibres. The long fibres are pulled by separation force out of the fibre material clamped in the feed nip, short fibres remaining behind through the retaining force in the feed nip. Subsequently, as the fibre bundle is transferred from the turning rotor onto the combing rotor the ends of the fibre bundle are reversed: the clamping device on the combing rotor grips and clamps the end with the long fibres, so that the region with the short fibres projects from the clamping device and lies exposed and can thereby be combed out.

In one illustrative embodiment, the clamping device for creating individual fibre bundles comprises a rotatably mounted first counter-element, which forms a clamping site with clamping elements on the first roller. In some embodiments, the counter-element may be a roller, e.g. a pressure-applying roller. In other embodiments, the arrangement may include an endlessly revolving belt. For example, the counter-element may be a guide roller of an endlessly revolving belt. Advantageously the belt portion facing the first roller forms a constriction with the clamping elements. In that way, the belt, in co-operation with the first roller, is able to clamp the advancing fibre lap or sliver and tear off a bundle of fibre material which can then be carried along a rotational path by the rotating first roller. If desired, the surface of the counter-element is profiled and/or the surface of the counter-element may be rubberised. In certain embodiments, the counter-element opposite the first roller may be stationary.

The clamping elements of the rotating first roller may be of any suitable kind, for example, they may comprise raised portions as clamping elements distributed spaced apart in the region of its cylindrical surface. Advantageously, the counter-element—seen in the direction of rotation of the first roller—is arranged between the supply device and the delivery point from the first roller to the second roller.

As already mentioned, detached fibre bundles may in some embodiments wholly or in part be held on the first roller by a suction air current. For that purpose, the first roller may have a plurality of air passage openings at its cylindrical surface. The air passage openings may be connected to a suction air source (source of negative pressure) to generate a suction air current. Advantageously, on the first roller suction channels are present between air passage openings and a reduced pressure region within the first roller. Advantageously, on the first roller the clamping elements have air passage openings.

Advantageously, on the first roller the clamping elements are mounted so as to be radially movable. For example, the clamping elements on the first roller may be spring-loaded.

In another illustrative embodiment, resilient raised portions are present on the first roller as clamping elements. Advantageously, the first roller is a perforated drum acted upon by suction. Advantageously, within the first roller an air screen element is present, which is capable of separating some of the air passage openings from the suction source. Preferably, the air screen element—seen in the direction of rotation of the first roller—is arranged between the delivery point from the first roller to the second roller and the counter-element. Advantageously, in the case of the first roller the suction air current is arranged to be only strong (intense) enough to hold the fibre bundle (fibre portion) on the first roller from the release of the clamping device up to delivery to the second roller. Advantageously, on the first roller the arrangement is such that the suction air current is able to apply suction only to the clamped end of the fibre bundle (fibre portion).

Advantageously, the at least two rotatably mounted, rapidly rotating rollers are a first roller (turning rotor) and a second roller (combing rotor). Advantageously, the first roller (turning rotor) and the second roller (combing rotor) are arranged axially parallel with respect to one another. Advantageously, the turning rotor and the combing rotor have opposite directions of rotation.

The second roller preferably comprises a multiplicity of clamping elements distributed spaced apart from one another in the region of the periphery of the second roller. Advantageously, on the second roller the clamping devices each comprise a gripper element (upper nipper) and a counter-element (lower nipper). Advantageously, the gripper element is articulated at a pivot bearing. Advantageously, on the second roller each counter-element is in a fixed position.

Advantageously, in the case of the second roller the clamping devices are secured to the roller. Advantageously, in the case of the second roller the clamping devices are arranged in the roller. Advantageously, at the second roller, for applying suction to the fibre bundles (fibre portions) supplied from the first roller, suction devices, suction channels or the like are associated with the clamping devices. Advantageously, mechanical means that comb out the fibre bundle from the clamping site to the free end are associated with the second roller. In one embodiment, in the case of the second roller the mechanical means (combing elements) may be arranged opposite the periphery of the roller. In another embodiment, a rotating roller having a plurality of combing elements is arranged within the second roller. In a further embodiment, the second roller may have a plurality of circular combs in the region of its periphery.

In certain embodiments it may be desirable to provide for suction at transfer points. For example, for suction of the supplied fibre bundles at least one suction device may be associated with the clamping device in the region of the delivery of the fibre bundle from the supply device to the first roller and/or at least one suction device may be associated with the clamping devices in the region of the delivery of the fibre material from the first roller to the second roller.

The invention further provides an apparatus for the fibre-sorting or fibre-selection of a fibre sliver comprising textile fibres, especially for combing, which is supplied by means of supply means to a fibre-sorting device, especially a combing device, in which clamping devices are provided which clamp the fibre sliver at a distance from its free end, and mechanical means are present which generate a combing action from the clamping site to the free end of the fibre sliver, in order to loosen and remove non-clamped constituents, such as, for example, short fibres, neps, dust and the like from the free end, wherein for transfer of the supplied fibre material a clamping element is present, wherein downstream of the supply means there are arranged at least two rotatably mounted rollers rotating rapidly without interruption which are provided with clamping devices for the fibre slivers transported in rotation, which clamping devices are distributed spaced apart in the region of their periphery, and which co-operate with counter-elements, wherein the counter-elements in the case of the first roller are arranged lying opposite the periphery of the roller and in the case of the second roller are arranged on or in the roller.

DESCRIPTION OF CERTAIN PREFERRED EMBODIMENTS

Figure 1:
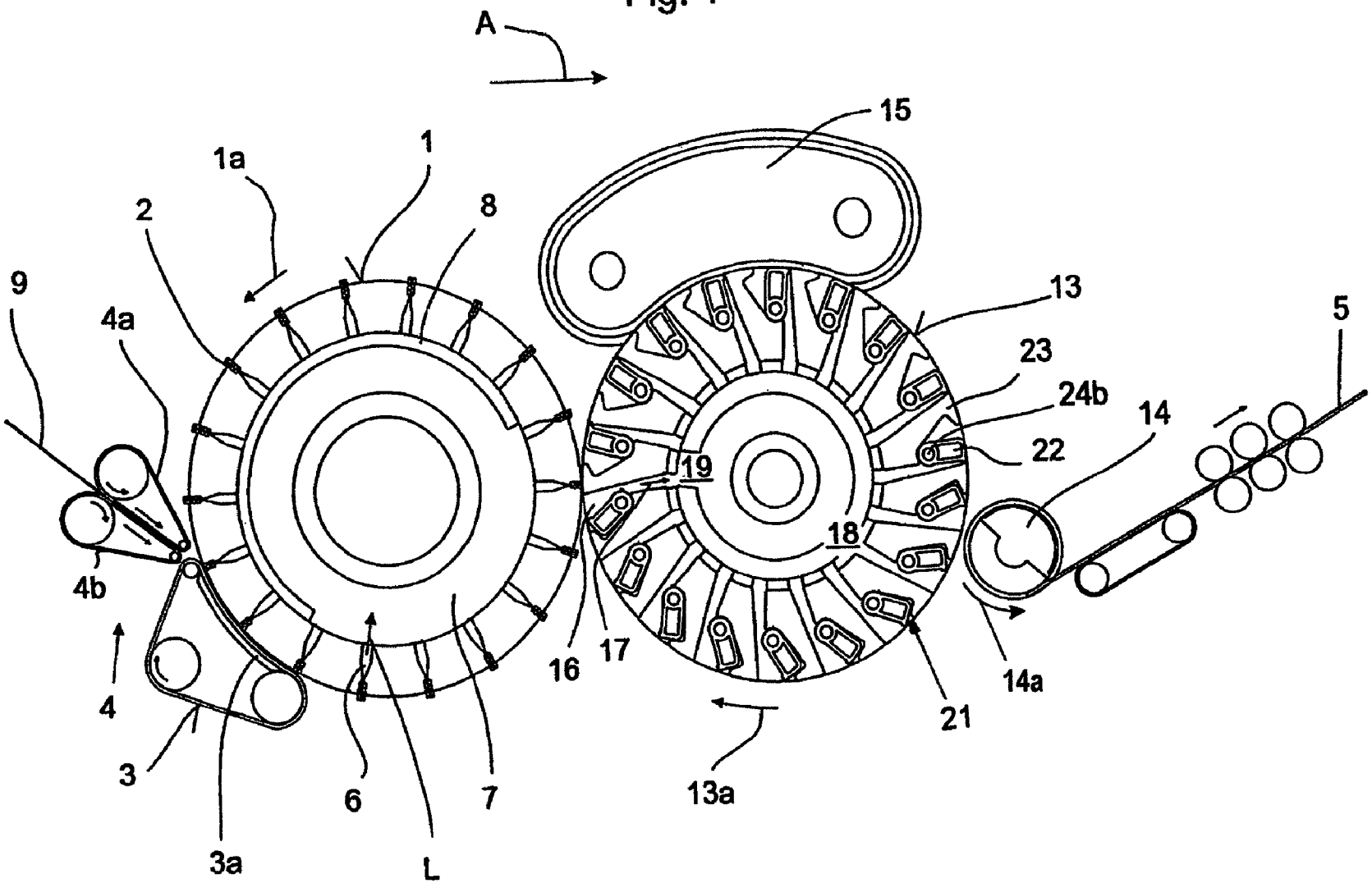
FIG. 1 is a diagrammatic side view of a rotor combing machine according to the invention, in which on the first roller (turning rotor) counter-elements are arranged lying opposite the clamping elements and the fibre sliver (fibre bundle) is partially acted upon by suction.

FIG. 1 shows a rotor combing machine having a supply device 4, a first roller 1 (turning rotor), a second roller 13 (combing rotor), a take-off device comprising a take-off roller 14 and a revolving card top combing assembly 15. The directions of rotation of the rollers 1, 13 and 14 are shown by curved arrows 1*a*, 13*a* and 14*a*, respectively. The incoming fibre material is indicated by reference numeral 9. The rollers 1, 13 and 14 are arranged one after the other. Arrow A denotes the operating direction.

With reference to FIG. 1, on the first roller 1 (turning rotor) clamping elements 2 are present, opposite which a conveyor belt 3 is arranged as counter-element, wherein the fibre bundle 5 (see FIG. 2) is held partly by suction on the first roller 1.

The fibre material 9 is fed by a supply device 4 comprising two co-operating endlessly revolving conveyor belts 4*a*, 4*b* into the gap between the roller 1 and the conveyor belt 3. Through clamping between the clamping elements 2 and the belt portion 3*a* of the conveyor belt 3 facing towards the roller 1, fibre bundles 5 (see FIG. 2) are formed (detached) and carried out of the gap between the roller 1 and the conveyor belt 3. Subsequently an end region of each fibre bundle 5 (see FIG. 2) is firmly held on the surface of the roller 1 by a suction air current "L" of a suction channel 6, which is connected to a reduced pressure region 7. In a subregion,—primarily from the transfer point between the first roller 1 and the second roller 13 as far as delivery of the fibre bundle 5 from the gap between first roller 1 and counter-element 3—a screen element 8 effects closure of the suction openings of the suction channels 6.

The fibre bundle 5 is subsequently transferred onto the second roller 13 (combing rotor). The second roller 13 is provided in the region of its outer periphery with a plurality of two-part clamping devices 21 which extend across the width of the roller 13 and each consist of an upper nipper 22 (gripping element) and a lower nipper 23 (counter-element). In its one end region facing the centre point or the pivot axis of the roller 13, each upper nipper 22 is rotatably mounted on a pivot bearing 24*b*, which is attached to the roller 13. The lower nipper 23 is fixedly mounted on the roller 13. The free end of the upper nipper 22 faces the periphery of the roller 13. The upper nipper 22 and the lower nipper 23 co-operate so that they are able to grip a fibre bundle (clamping) and release it. In the case of roller 13, around the roller periphery between the first roller 1 and doffer 14 the clamping devices 21 are closed they clamp fibre bundles (not shown) at one end and between the doffer 14 and the first roller 1 the clamping devices 21 are open. The rotatably mounted second roller 13 is equipped with clamping devices 22, 23 and additionally with suction channels 16 (suction openings), which, in the region of the delivery between the rollers 1 and 13, influence the alignment and movement of the fibres to be transported. In that way, the time for delivery from the first roller 1 to the second roller 13 is significantly reduced, so that the nip rate can be increased. The suction openings 16 are arranged within the roller 13 and rotate with the roller. At least one suction opening 16 is associated with each clamping device 22, 23 (nipper device). The suction openings 16 are each arranged between a gripping element (upper nipper) and counter-element (lower nipper). In the interior of the rotor 13 there is a reduced pressure region 17 to 19, created by the suction flow at the suction openings 16. The reduced pressure can be generated by connecting to a flow-generating machine. The suction flow at the individual suction openings 16 can be so switched between reduced pressure region and suction opening that it is applied only at particular selected angular positions on the roller periphery. For the purpose of the switching, valves or a valve pipe 18 with openings 19 in the corresponding angular positions can be used. The release of the suction flow may also be brought about by the movement of the gripping element (upper nipper). Furthermore, it is possible to arrange a region of reduced pressure only at the corresponding angular positions. The combed-out fibre bundle passes from the second roller 13 onto the piecing roller 14. Reference numeral A denotes the operating direction.

Figure 2:
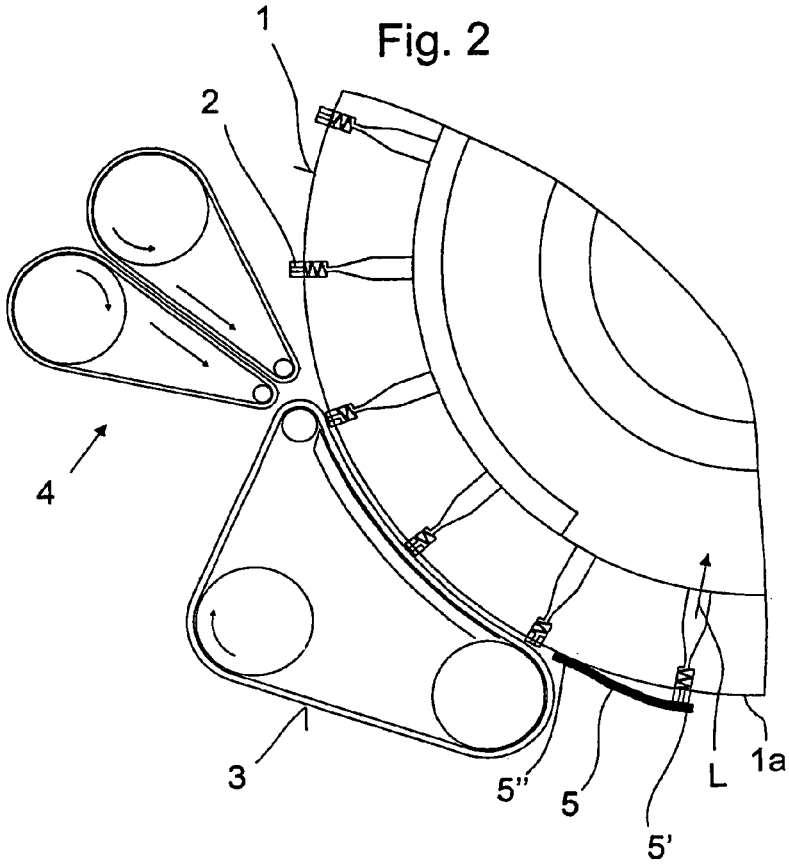
FIG. 2 is a cut-out from the first roller according to FIG. 1 with spring-loaded clamping elements.
Figure 2A:
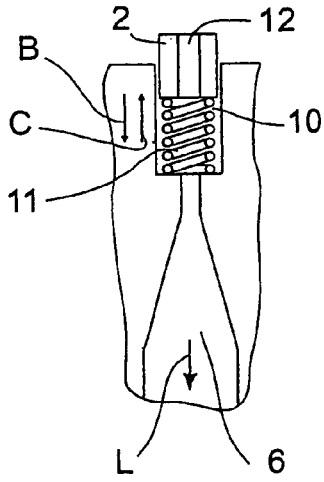
FIG. 2*a* is a detail view to an enlarged scale of the spring-loaded clamping element.

As shown in more detail in FIG. 2, on the periphery of the roller 1 there are blind bores 10, in which the clamping elements 2 are mounted in such a way that one part is arranged in the blind bore 10 and the other part projects from the blind bore 10 and thus protrudes beyond the cylindrical surface of the roller 1. In accordance with FIG. 2*a*, arranged inside each blind bore 10 is a compression spring 11, which with one end loads the part of the clamping element 2 lying inside and with its other end is supported on the bottom face of the blind bore 10. The clamping element 2 is thus movable in direction B, C. An air-permeable opening (bore), to which the suction channel 6 is connected, is present in the bottom face of the blind bore 10. In the axial direction the clamping element 2 has a continuous bore 12. In this way, the suction air current L passes via the suction channel 6 and the inner space of the blind bore 10 right through the bore 12 and applies suction to an end portion 5' of the fibre bundle 5 (see FIG. 2) and thereby holds the fibre bundle 5 firmly on the cylindrical surface 1*a* of the roller 1. The end region 5" not acted upon by suction is free, so that the fibre bundle 5 is only partially subjected to the suction action of the suction air current L. In this connection, the strength of the suction air current L is only such that the fibre bundle 5 is firmly held on the roller 1.

Figure 3:
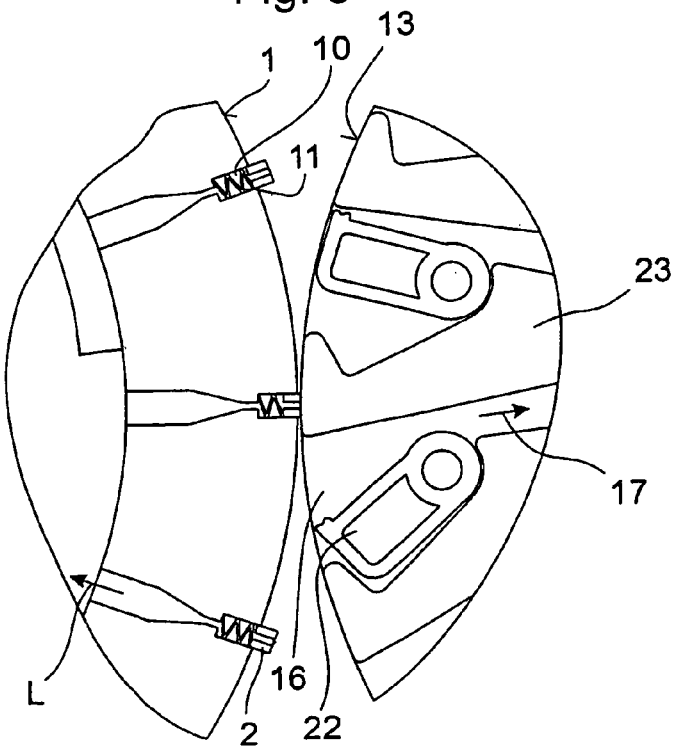
FIG. 3 is a cut-out to an enlarged scale at the delivery point between first roller and second roller according to FIG. 1, but with spring-loaded clamping elements according to FIG. 2.

With reference to FIG. 3, the fibre bundle 5 is being delivered from the first roller 1 to the second roller 13. In the region of the narrowest point, the clamping element 2 is moved in direction B against the force of the compression spring 11 and presses against the fixed-position bottom nipper 23. The suction flow L is interrupted, so that the holding effect is terminated. An end region of the fibre bundle 5 is pulled by a suction flow 17 into a suction opening 16 between the nipper elements 22 and 23, which—viewed in the direction of rotation 13*a*—subsequently close, with the result that the fibre bundle is supplied to the mechanical combing device 15 (see FIG. 1) for mechanical combing.

Figure 4:
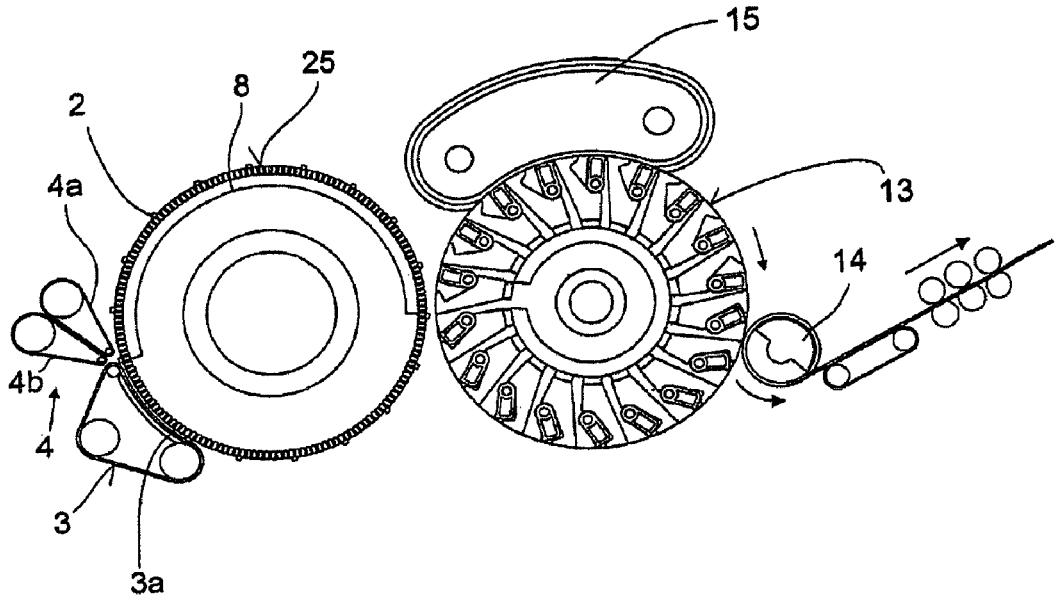
FIG. 4 is a diagrammatic side view of a further embodiment of the rotor combing machine, in which air passage openings are present on the periphery of the first roller (perforated drum acted upon by suction) and the counter-element lying opposite the clamping elements is a revolving conveyor belt.
Figure 4A:
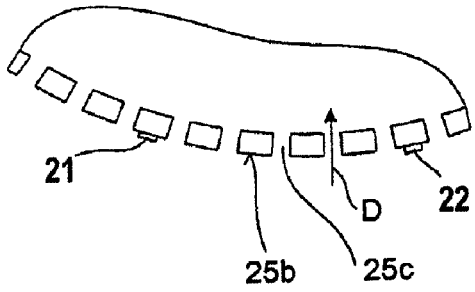
FIG. 4*a* is a cut-out from the cylindrical surface of the perforated drum acted upon by suction.

In a further embodiment shown in FIG. 4, a rotor combing machine comprises two rollers, the first roller 25 (turning rotor) being in the form of a perforated drum. The second roller (combing rotor) is constructed as illustrated in and described with reference to FIG. 1. The fibre material 9 is supplied to the first roller 25 by a supply device 4 (which is described with reference to FIG. 1). On the cylindrical surface (periphery) of the first roller 25 there is a plurality of clamping elements 21, 22, which co-operate with a counter-element in the form of a conveyor belt 3 (cf. FIG. 1). According to FIG. 4*a*, in the cylindrical surface 25*b* of the perforated drum 25 of FIG. 4 there are air passage openings 25*c*, through which a suction air current D passes into the interior, which is under suction. In this way, the fibre bundle 5 (see FIG. 2) is held firmly on the surface 25*b* of the perforated drum by the suction air currents D from air passage openings 25 arranged side by side. The strength of the suction air current D is only such that the fibre bundle 5 is firmly held.

Figure 5:
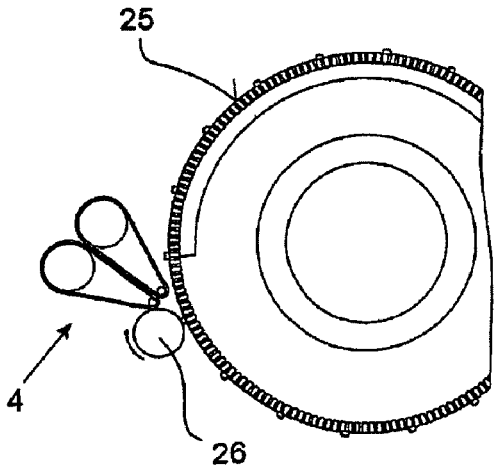
FIG. 5 is a cut-out from the first roller of a rotor combing machine generally similar in construction to that of FIG. 4, but with a rotating roller as the counter-element.

In the embodiment of FIG. 5, a rotatable roller 26—instead of the revolving conveyor belt 3 according to FIG. 4—is present as counter-element for the clamping elements 21, 22.

Figure 6:
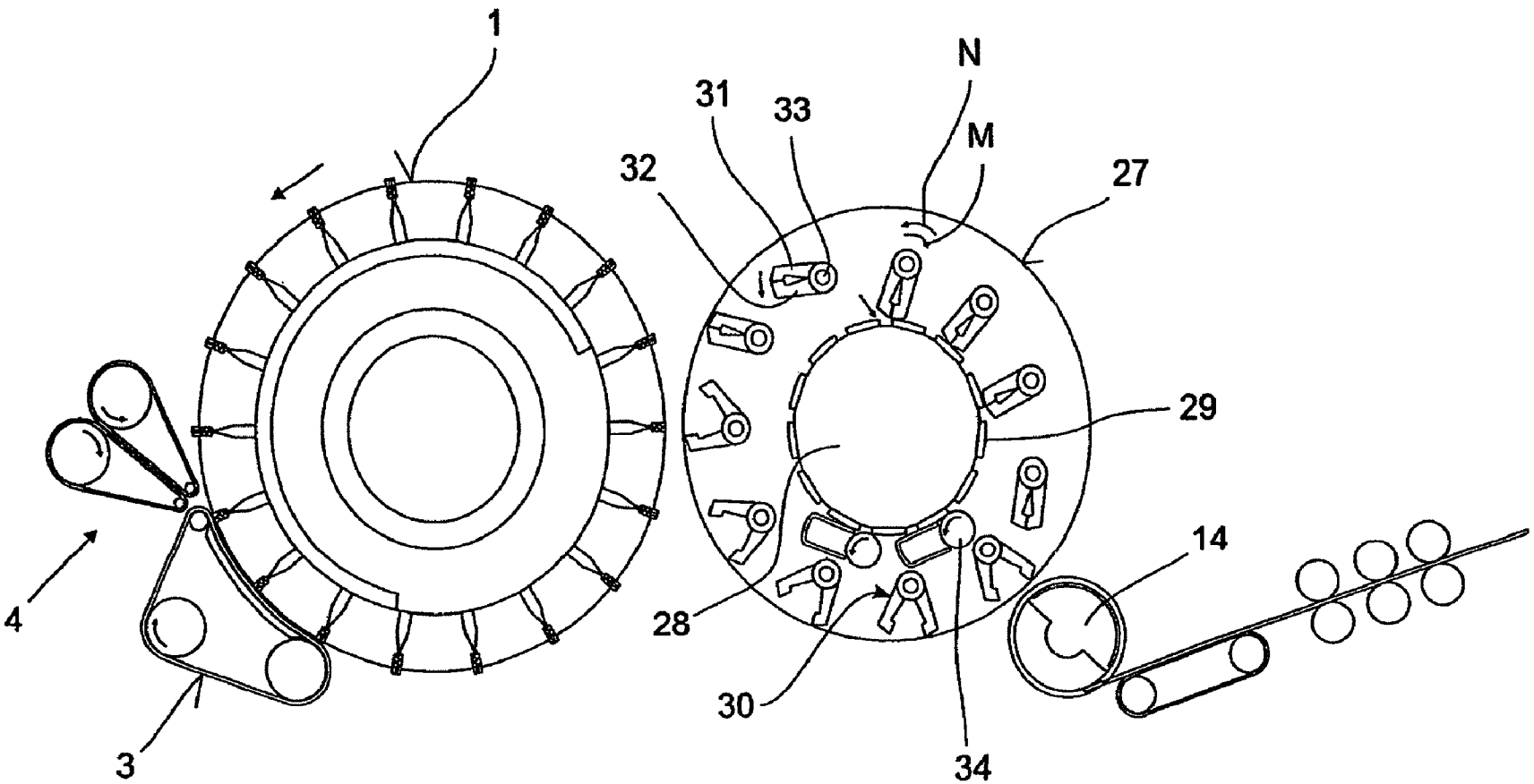
FIG. 6 is a diagrammatic side view of another embodiment of the rotor combing machine, in which combing elements are arranged inside the second roller (combing rotor).

In yet a further embodiment shown in FIG. 6, a rotor combing machine has two rollers, the first roller 1 (turning rotor) being constructed as illustrated in and described with reference to FIG. 1. The fibre bundle 5 is transferred from the first roller 1 onto a second roller 27 (combing rotor). Inside the second roller 27, a further roller 28 equipped with a plurality of combing elements 29 rotates. The roller 28 is mounted concentrically with respect to the axis of the second roller 27. The roller 28 rotates continuously and uniformly in the same direction as or the opposite direction to the combing rotor 27. The nipper devices 30 consist of an upper nipper 31 and a lower nipper 32, which with their one end are rotatable about a pivot bearing 33 in directions M, N. In the closed state, the nipper devices 30 present the clamped fibre tufts to the combing elements 29 for combing. Through the relative movement between fibre tuft and combing element 29 the fibre tuft is combed out. Inside the rotor 27 there is a cleaning device, for example, a rotating cleaning roller 34, which cleans the combing elements 29. In the case of same-direction combing, the speed ratio between combing rotor 27 and the roller 28 with combing elements 29 is greater than 1. The combed-out fibre bundle passes from the combing rotor 27 onto the piecing roller 14.

In use of the rotor combing machine according to the invention there is achieved a mechanical combing of the fibre material to be combed, that is, mechanical means are used for the combing. There is no pneumatic combing of the fibre material to be combed, that is, no air currents, e.g. suction and/or blown air currents, are used for combing.

The circumferential speeds are, for example, for the feed roller or belts about from 0.2 to 1.0 m/sec; the first roller 1 about from 2.0 to 6.0 m/sec; the second roller 13 about from 2.0 to 6.0 m/sec; the doffer about from 0.4 to 1.5 m/sec; and the revolving card top assembly about from 1.5 to 4.5 m/sec.

The diameter of the first roller 12 and the second roller 13 is, for example, about from 0.3 m to 0.8 m.

Using the rotor combing machine according to the invention, more than 2000 nips/min, for example from 3000 to 5000 nips/min, are achievable.

In the rotor combing machine according to the invention there are present rollers that rotate rapidly without interruption (continuously) and that have clamping devices. Rollers that rotate with interruptions, stepwise or alternating between a stationary and rotating state are not used.

Although the foregoing invention has been described in detail by way of illustration and example for purposes of understanding, it will be obvious that changes and modifications may be practised within the scope of the appended claims.

What is claimed is:

1. An apparatus for the fibre-sorting or fibre-selection of a fibre bundle comprising textile fibres, the apparatus comprising:

a fibre-sorting device;

a supply device adapted to supply the fibre bundle to the fibre-sorting device; and at least one mechanical device adapted to generate a combing action in order to loosen and remove non-clamped constituents from the fibre bundle;

wherein the fibre-sorting device comprises:

a first roller and a second roller arranged downstream of the supply device, wherein, in use, the first roller and second roller rotate rapidly without interruption, first clamping elements distributed spaced apart in a peripheral region of the first roller, one or more first counter-elements cooperating with the first clamping elements, the one or more first counter-elements located opposite to the first roller and the peripheral region of the first roller, second clamping elements distributed spaced apart in a peripheral region of the second roller, and one or more second counter-elements cooperating with the second clamping elements, the one or more second counter elements arranged on or inside the first roller.

2. An apparatus for the fibre-sorting or fibre-selection of a fibre bundle comprising textile fibres having:

a fibre-sorting device;

a supply device for supplying the fibre bundle to the fibre-sorting device; and at least one mechanical device for generating a combing action in order to loosen and remove non-clamped constituents from the fibre bundle;

wherein the fibre-sorting device comprises, arranged downstream of the supply device, at least two rotatably mounted rollers that, in use, rotate rapidly without interruption, each of said at least two rollers having clamping elements distributed spaced apart in the region of their periphery and co-operating with one or more counter-elements, wherein the counter-elements in the case of the first roller are opposite the periphery of the roller and the counter-elements in the case of the second roller are arranged on or in the roller, wherein on the first roller a suction air current acts on the fibre bundle, which suction air current is capable of holding the fibre bundle on the first roller.

3. An apparatus according to claim 1, wherein the first clamping elements and one or more first counter-elements associated with the first roller for are adapted to separate supplied fibre material stepwise into individual fibre bundles.

4. An apparatus according to claim 3, in which the one or more first counter-elements comprise at least one rotatably mounted counter-element, which forms a clamping site with the first clamping elements on the first roller.

5. An apparatus for the fibre-sorting or fibre-selection of a fibre bundle comprising textile fibres having:

a fibre-sorting device, a supply device for supplying the fibre bundle to the fibre-sorting device; and at least one mechanical device for generating a combing action in order to loosen and remove non-clamped constituents from the fibre bundle;

wherein the fibre-sorting device comprises, arranged downstream of the supply device, at least two rotatably mounted rollers that, in use, rotate rapidly without interruption, each of said at least two rollers having clamping elements distributed spaced apart in the region of their periphery and co-operating with one or more counter-elements, wherein the counter-elements in the case of the first roller are opposite the periphery of the roller and the counter-elements in the case of the second roller are arranged on or in the roller;

further comprising clamping elements and one or more counter-elements associated with the first roller for separating the supplied fibre material stepwise into individual fibre bundles, wherein the one or more counter-elements comprise at least one rotatably mounted counter-element, which forms a clamping site with clamping elements on the first roller, and the one or more counter-elements is a counter-roller.

6. An apparatus according to claim 5, in which the counter-element comprises an endlessly revolving belt having a guide roller.

7. An apparatus according to claim 6, in which the belt portion facing the first roller forms a constriction with the clamping elements.

8. An apparatus for the fibre-sorting or fibre-selection of a fibre bundle comprising textile fibres having:

a fibre-sorting device;

a supply device for supplying the fibre bundle to the fibre-sorting device; and at least one mechanical device for generating a combing action in order to loosen and remove non-clamped constituents from the fibre bundle;

wherein the fibre-sorting device comprises, arranged downstream of the supply device, at least two rotatably mounted rollers that, in use, rotate rapidly without interruption, each of said at least two rollers having clamping elements distributed spaced apart in the region of their periphery and co-operating with one or more counter-elements, wherein the counter-elements in the case of the first roller are opposite the periphery of the roller and the counter-elements in the case of the second roller are arranged on or in the roller, and wherein the counter-element opposite the first roller is stationary.

9. An apparatus according to claim 1, in which the clamping elements on the first roller comprise raised portions distributed spaced apart in the region of its cylindrical surface.

10. An apparatus according to claim 1, in which the first counter-element is arranged between the supply device and a delivery point from the first roller to the second roller.

11. An apparatus for the fibre-sorting or fibre-selection of a fibre bundle comprising textile fibres having:

a fibre-sorting device, a supply device for supplying the fibre bundle to the fibre-sorting device; and at least one mechanical device for generating a combing action in order to loosen and remove non-clamped constituents from the fibre bundle;

wherein the fibre-sorting device comprises, arranged downstream of the supply device, at least two rotatably mounted rollers that, in use, rotate rapidly without interruption, each of said at least two rollers having clamping elements distributed spaced apart in the region of their periphery and co-operating with one or more counter-elements, wherein the counter-elements in the case of the first roller are opposite the periphery of the roller and the counter-elements in the case of the second roller are arranged on or in the roller, and wherein the first roller has a plurality of air passage openings at its cylindrical surface which are connected to a suction air source to generate a suction air current.

12. An apparatus according to claim 1, in which the first clamping elements have air passage openings.

13. An apparatus for the fibre-sorting or fibre-selection of a fibre bundle comprising textile fibres having:

a fibre-sorting device;

a supply device for supplying the fibre bundle to the fibre-sorting device; and at least one mechanical device for generating a combing action in order to loosen and remove non-clamped constituents from the fibre bundle;

wherein the fibre-sorting device comprises, arranged downstream of the supply device, at least two rotatably mounted rollers that, in use, rotate rapidly without interruption, each of said at least two rollers having clamping elements distributed spaced apart in the region of their periphery and co-operating with one or more counter-elements, wherein the counter-elements in the case of the first roller are opposite the periphery of the roller and the counter-elements in the case of the second roller are arranged on or in the roller, the apparatus further comprising an air screen element present within the first roller, which is capable of separating some of the air passage openings from the suction source, the air screen element—seen in the direction of rotation of the first roller—being arranged between the delivery point from the first roller to the second roller and the counter-element.

14. An apparatus according to claim 1, in which the first clamping elements are mounted on the first roller so as to be radially movable.

15. An apparatus according to claim 14, in which the first clamping elements are spring-loaded.

16. An apparatus according to claim 1, in which the first clamping elements on the first roller comprise resilient raised portions.

17. An apparatus according to claim 2, in which on the first roller the suction air current is arranged to apply suction only to an end portion of the fibre bundle.

18. An apparatus according to claim 1, in which the second roller has a plurality of second clamping devices which each comprise a gripper element and a counter-element.

19. An apparatus according to claim 18, in which on the second roller the or each second counter-element is in a fixed position.

20. An apparatus according to claim 1, wherein the second clamping devices are secured to and/or arranged in the second roller.

21. An apparatus according to claim 20, in which the second clamping devices are each arranged to clamp a fibre bundle at a distance from its free end, and the at least one mechanical device for generating a combing action is associated with the second roller and is arranged to comb out the fibre bundle from the clamping site to the free end.

22. An apparatus according to claim 21, in which the mechanical combing device comprises combing elements arranged opposite the periphery of the second roller.

23. An apparatus according to claim 21, in which the mechanical combing device comprises a rotating roller having a plurality of combing elements arranged within the second roller.

24. An apparatus according to claim 1, in which the first roller and the second roller have opposite directions of rotation.

25. An apparatus according to claim 1, in which the first and second rollers comprise a turning rotor and a combing rotor, the turning rotor and combing rotor having opposite directions of rotation.

* * * * *